US011459787B2

(12) United States Patent
Kightlinger et al.

(10) Patent No.: US 11,459,787 B2
(45) Date of Patent: Oct. 4, 2022

(54) REINFORCED MECHANICAL POST

(71) Applicant: Kane Innovations, Inc., Erie, PA (US)

(72) Inventors: Mark E. Kightlinger, Erie, PA (US); Jerome Dunn, Erie, PA (US)

(73) Assignee: Kane Innovations, Inc., Erie, PA (US)

( * ) Notice: Subject to any disclaimer, the term of this patent is extended or adjusted under 35 U.S.C. 154(b) by 0 days.

(21) Appl. No.: 17/177,739

(22) Filed: Feb. 17, 2021

(65) Prior Publication Data

US 2021/0262247 A1 Aug. 26, 2021

Related U.S. Application Data

(60) Provisional application No. 62/980,024, filed on Feb. 21, 2020.

(51) Int. Cl.

| | |
|---|---|
| ***E04H 12/22*** | (2006.01) |
| ***E04H 12/08*** | (2006.01) |
| ***E04F 11/18*** | (2006.01) |
| ***E04H 17/20*** | (2006.01) |
| ***E04H 17/22*** | (2006.01) |

(52) U.S. Cl.

CPC ..... *E04H 12/2276* (2013.01); *E04F 11/1812* (2013.01); *E04H 12/08* (2013.01); *E04H 12/2261* (2013.01); *E04H 17/21* (2021.01); *E04H 17/22* (2013.01)

(58) Field of Classification Search

CPC ..... E04H 12/08; E04H 12/2261; E04H 17/21; E04H 17/22; E04H 17/20; E04F 11/1812

See application file for complete search history.

(56) References Cited

U.S. PATENT DOCUMENTS

| | | | | |
|---|---|---|---|---|
| 4,388,787 | A * | 6/1983 | Milbright | E04H 12/2276 52/298 |
| 5,454,661 | A * | 10/1995 | Litvin | F16B 7/0413 403/292 |
| 2006/0150572 | A1* | 7/2006 | Rawson-Harris | E01F 9/65 52/848 |
| 2007/0158526 | A1* | 7/2007 | Platt | E04H 12/2261 248/188.4 |
| 2007/0187564 | A1* | 8/2007 | McGuire | E04H 12/2261 248/346.5 |
| 2008/0121150 | A1* | 5/2008 | Picchio | A47B 13/023 248/161 |
| 2010/0263249 | A1* | 10/2010 | Everitt | E04H 12/08 40/607.1 |
| 2013/0141902 | A1* | 6/2013 | Akdag | F24S 25/10 248/530 |

FOREIGN PATENT DOCUMENTS

| | | | | |
|---|---|---|---|---|
| DE | 102012000493 | A1 * | 8/2012 | E04F 11/1804 |
| FR | 2576048 | A1 * | 7/1986 | |
| GB | 2577923 | A * | 4/2020 | E04C 3/32 |
| KR | 101451555 | B1 * | 10/2014 | |
| WO | WO-8607620 | A1 * | 12/1986 | |

* cited by examiner

*Primary Examiner* — Adriana Figueroa
(74) *Attorney, Agent, or Firm* — Jonathan M. D'Silva; MMI Intellectual Property

(57) ABSTRACT

A reinforced post comprises a baseplate and a reinforcement member having at least one channel, with each channel for receiving a bolt. The baseplate has a hole for each channel. For each hole a bolt is engaged with the channel through the hole to secure the reinforcement member to the baseplate. A hollow post is positioned over the reinforcement member.

14 Claims, 14 Drawing Sheets

10

REINFORCED MECHANICAL POST

BACKGROUND

Traditional extruded metal fence and railing posts are welded to baseplates for mounting. Welds between these metal parts are inconsistent and prone to defects which can lead to weak bonding. Railing posts in particular must be able to withstand heavy loads as specified by the International Code Council or according to project specifications to ensure the safety of those using them. One inconsistent weld can lead to product failure which could lead to severe injury, so a stronger and more reliable mounting method is required. In addition, welding requires technical expertise and expensive equipment that is increasingly difficult to obtain. By replacing welds with reinforced mechanical posts as disclosed herein, it is possible to create stronger, safer, and more resilient post assemblies without the need for specialized equipment or skills.

SUMMARY

A reinforced post comprises a baseplate and a reinforcement member that has at least one channel. Each channel receives a bolt. The baseplate has a hole for each channel. For each hole a bolt engages with a channel through the hole to secure the reinforcement member to the baseplate. A hollow post is positioned over the reinforcement member. The baseplate of the reinforced post may be mounted to a surface. In some embodiments, each hole is counter sunk or recessed into the baseplate for bolt clearance.

In some embodiments, the hollow post has a snug fit over the reinforcement member. In some embodiments, the outer geometry of the reinforcement member corresponds to the inner geometry of the hollow post. The outer walls of the reinforcement member may be at least partially in contact with the inner walls of the hollow post.

In various embodiments, the hollow post is secured to the reinforcement member with screws, bolts, or other means. The hollow post may have a weephole for drainage. The reinforcement member may be any length between 6 inches and the length of the hollow post. The channel may have an opening for drainage. The reinforcement member may have grooves along its length for drainage. In various embodiments, the hollow post is connected to a railing, fence, sign, or other device.

In some embodiments, the reinforced comprises a reinforcement member having four channels. In embodiments where the reinforcement member has four said channels, it may be that the baseplate also has four holes corresponding to the channels.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF THE DRAWINGS

For a more complete understanding and appreciation of this invention, and its many advantages, reference will be made to the following detailed description taken in conjunction with the accompanying drawings.

DETAILED DESCRIPTION

Figure 1:
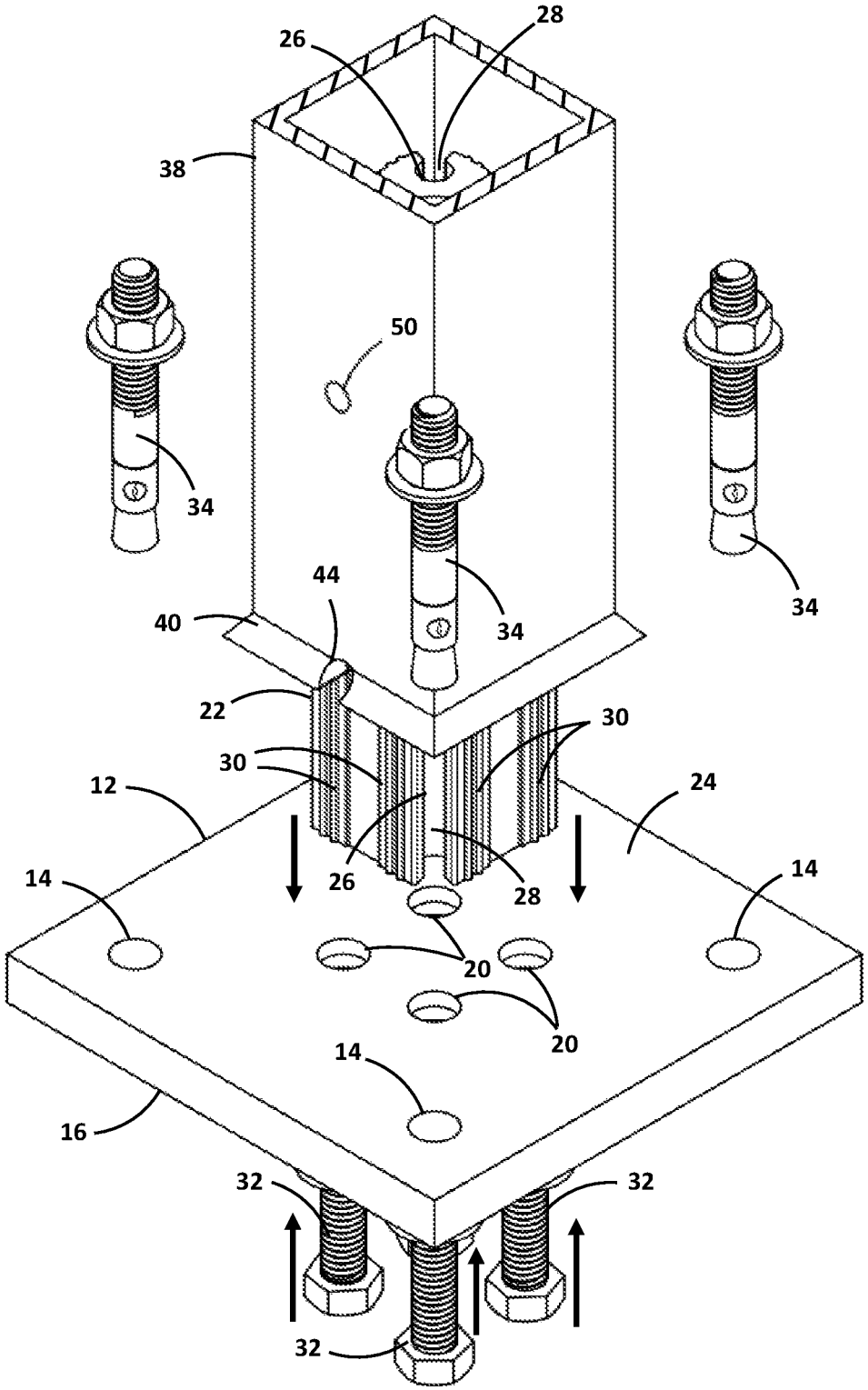
FIG. 1 is an exploded isometric view of a preferred embodiment of a reinforced mechanical post.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

What is disclosed is a reinforced mechanical post system. The preferred embodiment of the reinforced mechanical post system includes a baseplate having an outer set of mounting through holes for mounting the bottom face of the baseplate to a solid surface and an inner set of attachment through holes for attachment of a reinforcement member to the top face of the baseplate. The attachment through holes in the baseplate may be countersunk or recessed at the bottom face to enable flush contact between the bottom face of the baseplate and a mounting surface. The baseplate is a standard metal plate typically with a thickness of ⅝ in but could be as thick as ½ in or higher. Preferably the baseplate is a 5-inch by 5 inch square, but other dimensions and geometries are possible as desired.

The reinforcement member has an elongated body and at least one channel for receiving a bolt through an attachment through hole of the baseplate. The position and number of channels correspond to the position and number of attachment through holes present on the baseplate and may vary depending on the geometry of the reinforcement member or the expected load the system will undergo. It is preferred that the bolts that join the baseplate to the reinforcement member must be stronger than standard bolts in order to better serve as reinforcements. It is preferred that the bolts have a minimum strength of 1000-120 KSI and be fully threaded at a length of 1¾". In the preferred embodiment, the reinforcement member has a generally square body, but one can see that any geometry is possible. The length of the reinforcement member may vary from a minimum of 6-inches long and may extend up to the entire length of the hollow post. Preferably, the reinforcement member is an extruded section of metal for ease of manufacturing. In the case of an extruded reinforcement member, the channels may run the entire length of the member body and may be threaded to a length that accommodates the attachment bolts. The preferred embodiment of the reinforcement member has channels with an opening that runs the entire length of the channel. The opening in the channels prevent water buildup and allow any condensation to escape the reinforcement member. Grooves also run the entire length of the reinforcement member's outer walls for draining of condensation that forms within the reinforced post system.

Once the reinforcement member is secured to the baseplate a hollow post is positioned over it. The hollow post may assume any size or geometry and may have whatever wall thickness is required to maintain structural integrity for a given application. Preferably, the hollow post is an extruded 2-inch square with a wall thickness of 0.125-inches, but one of ordinary skill may see that any size or geometry is possible, however it is preferred that the hollow post has at least partial contact between the outer walls of the reinforcement member and the inner walls of the hollow post. In the preferred embodiment, the outer surface of the reinforcement member contacts the inner walls of the hollow post to provide a snug fit. The bottom edge of the hollow post may be flanged or tapered to increase the contact area with the baseplate and protect the reinforcement member. Within the bottom edge there may be a recessed area which creates a fluid connection between the grooves, and channel openings on each side of the reinforcement member. The bottom edge of the post may also contain a weep hole for drainage of any condensation within the reinforced mechanical post system that flows into to the recessed area. A cap may also be added to the top of the hollow post to prevent dirt, precipitation, and other contaminants from entering the reinforced mechanical post system. Depending on the geometrical combination of reinforcement member and hollow post, the location of drainage grooves/openings and weep holes may require further alteration.

Screws may be added through the sides of the hollow post such that they engage with the reinforcement member to prevent relative movement between the hollow post and the reinforcement member. These screws may be self-tapping screws or they may be threaded into pre drilled holes in the hollow post and reinforcement member that line up during assembly. Such screws may be specifically necessary if the hollow post does not have sides that contact the reinforcement member or if additional securing of the hollow post to the reinforcement member is required. Upward force on the hollow post exerts a shear force on these screws, and so the size and number of screws may be selected with regard to the anticipated load and wind conditions.

Figure 2:
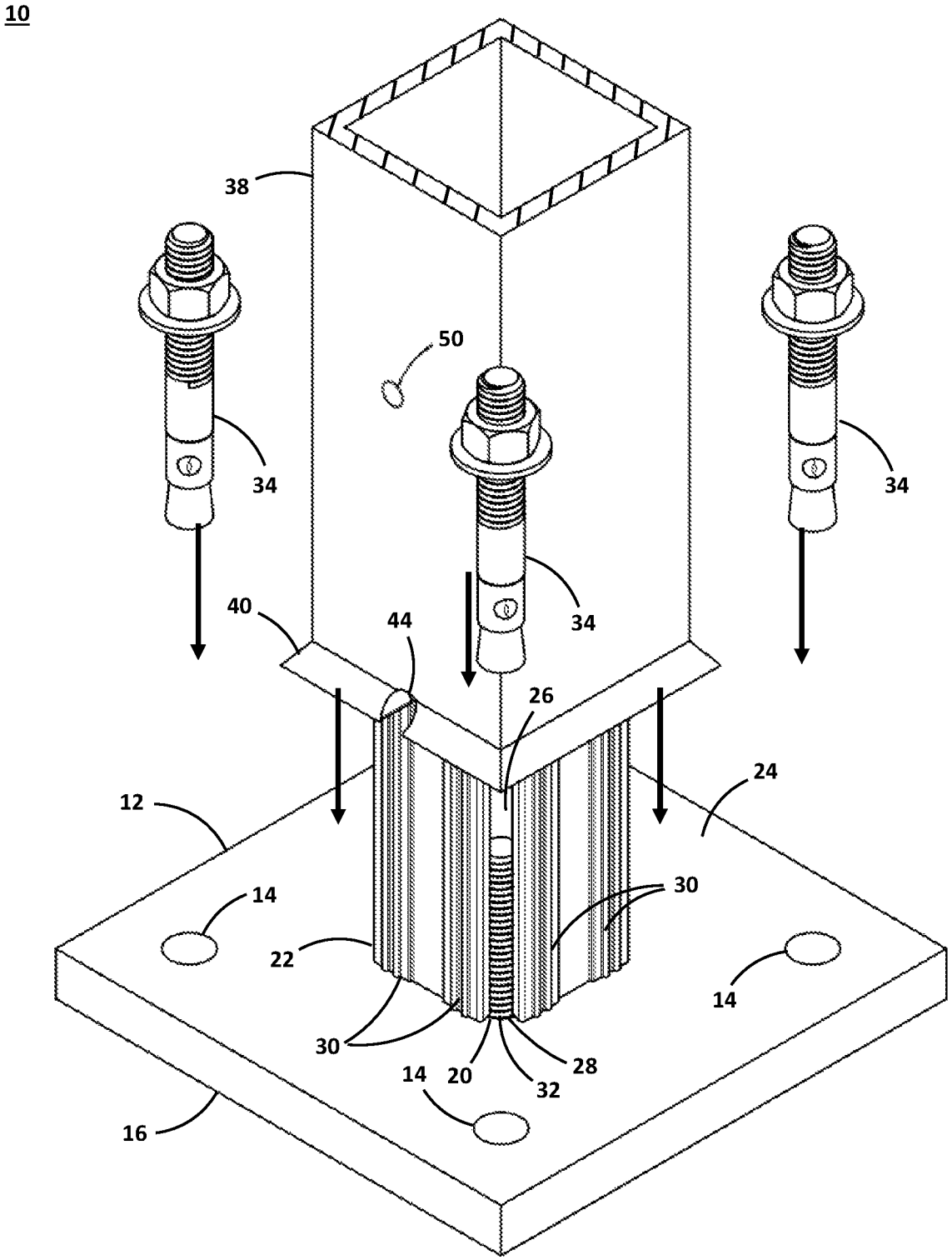
FIG. 2 is an isometric view of the reinforced mechanical post of FIG. 1 that is partially assembled.
Figure 3:
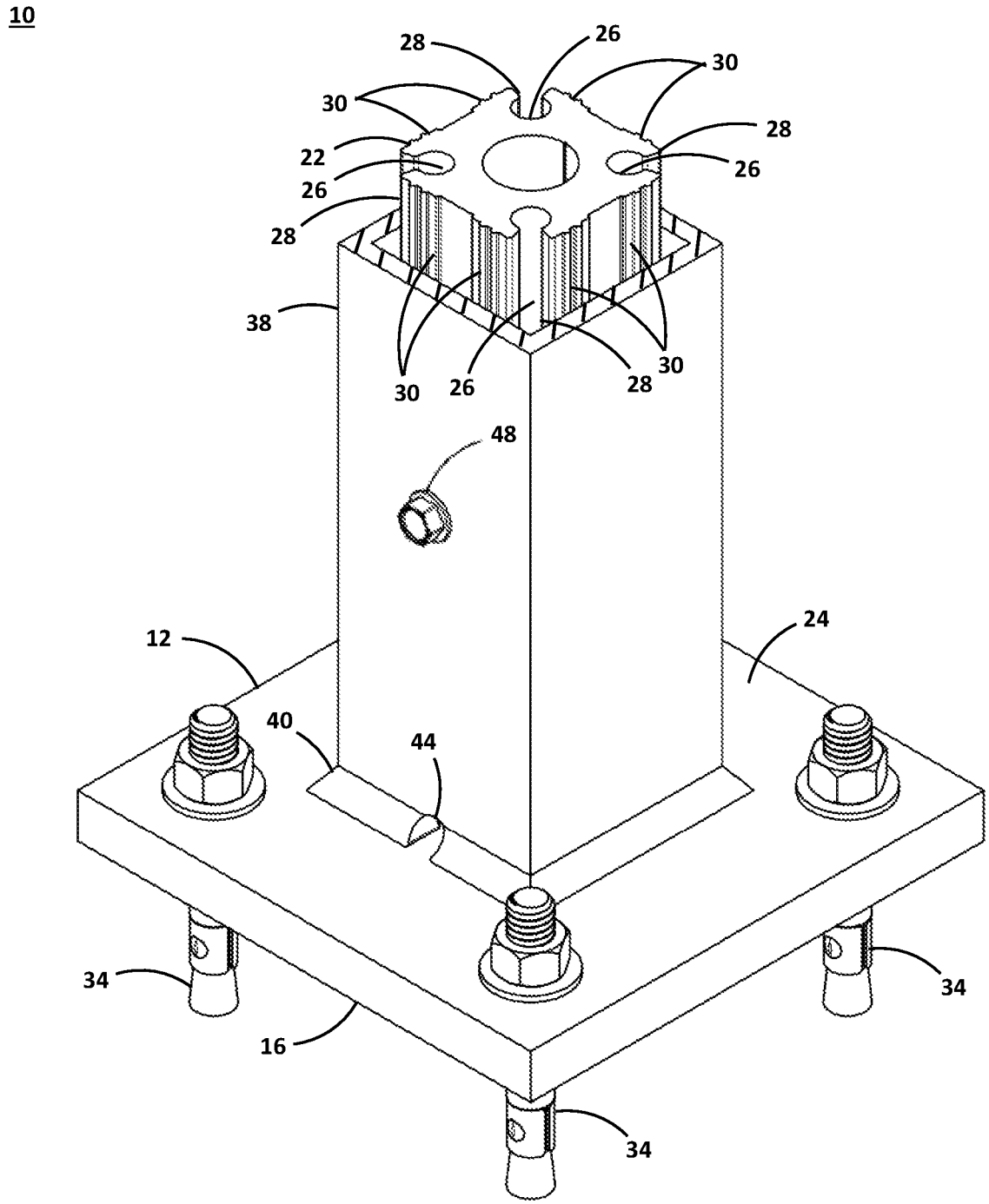
FIG. 3 is an isometric view the reinforced mechanical post of FIG. 1 that is fully assembled.
Figure 4:
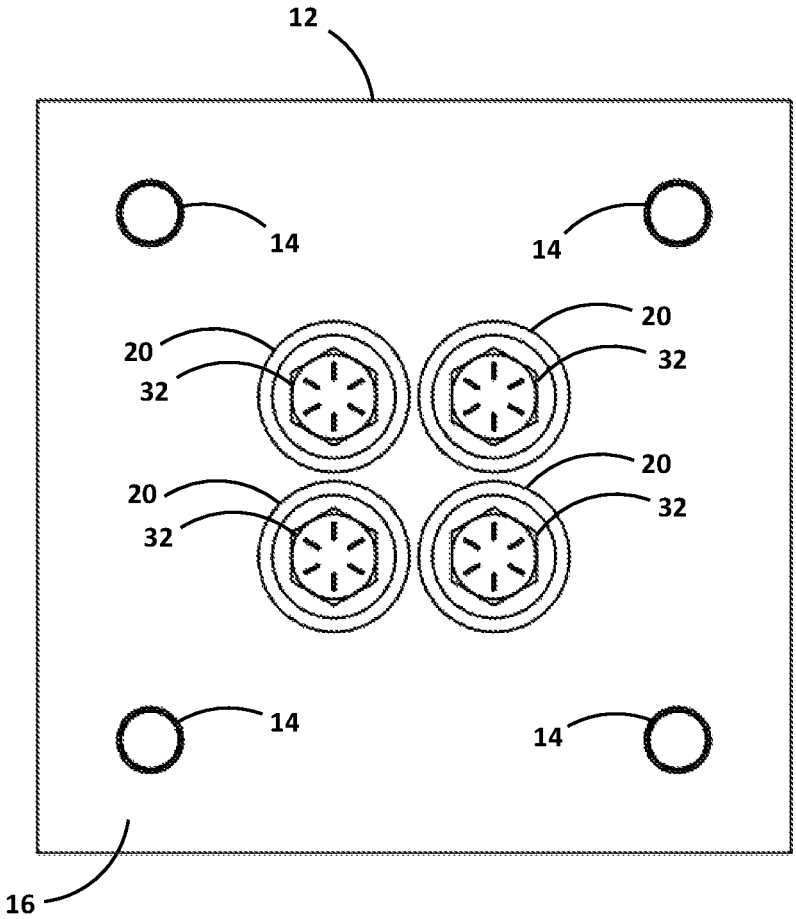
FIG. 4 is a bottom view of the reinforced mechanical post of FIG. 3.
Figure 5:
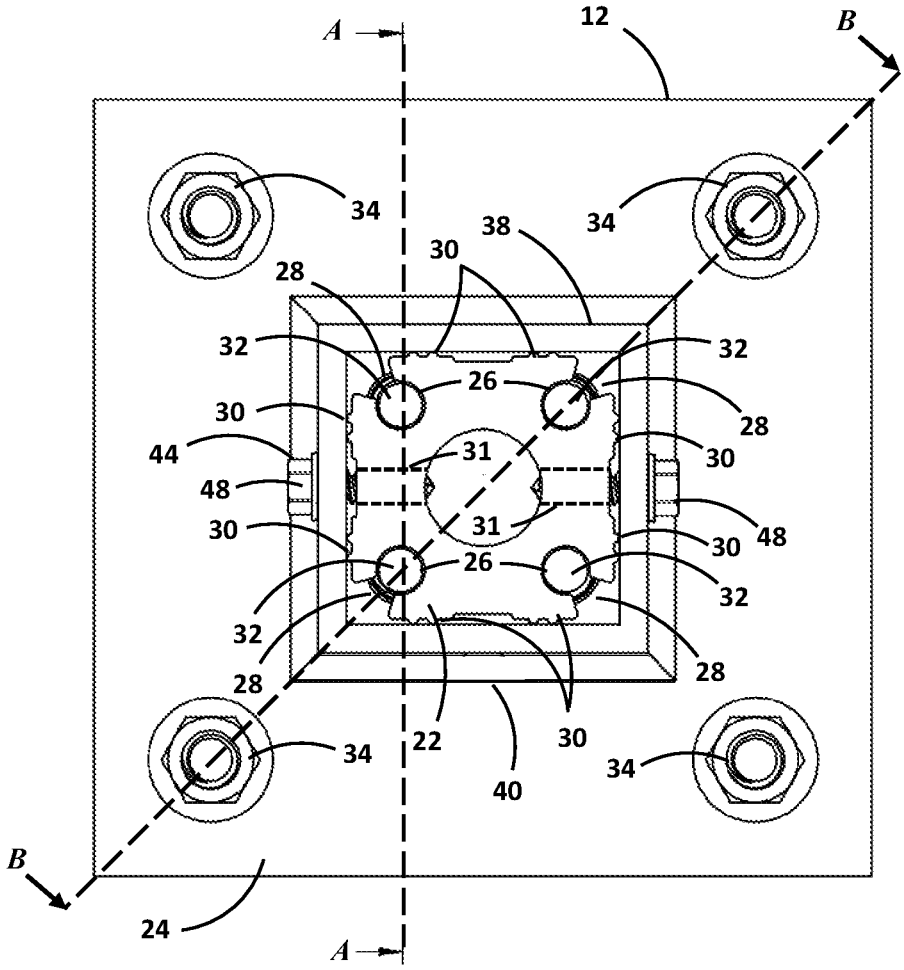
FIG. 5 is a top view the reinforced mechanical post of FIG. 3.
Figure 6:
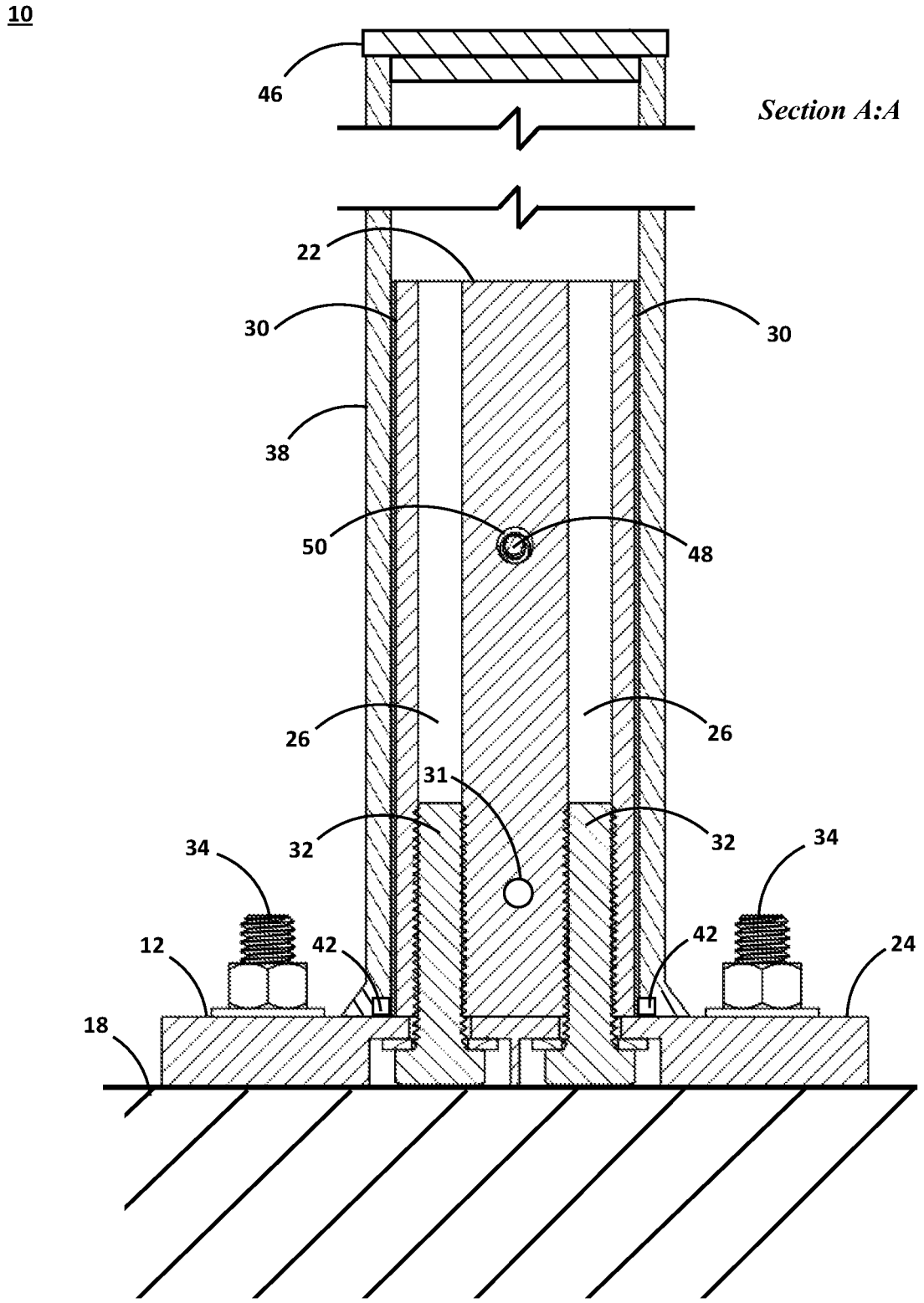
FIG. 6 is a cross section view along the line A-A from FIG. 3.
Figure 7:
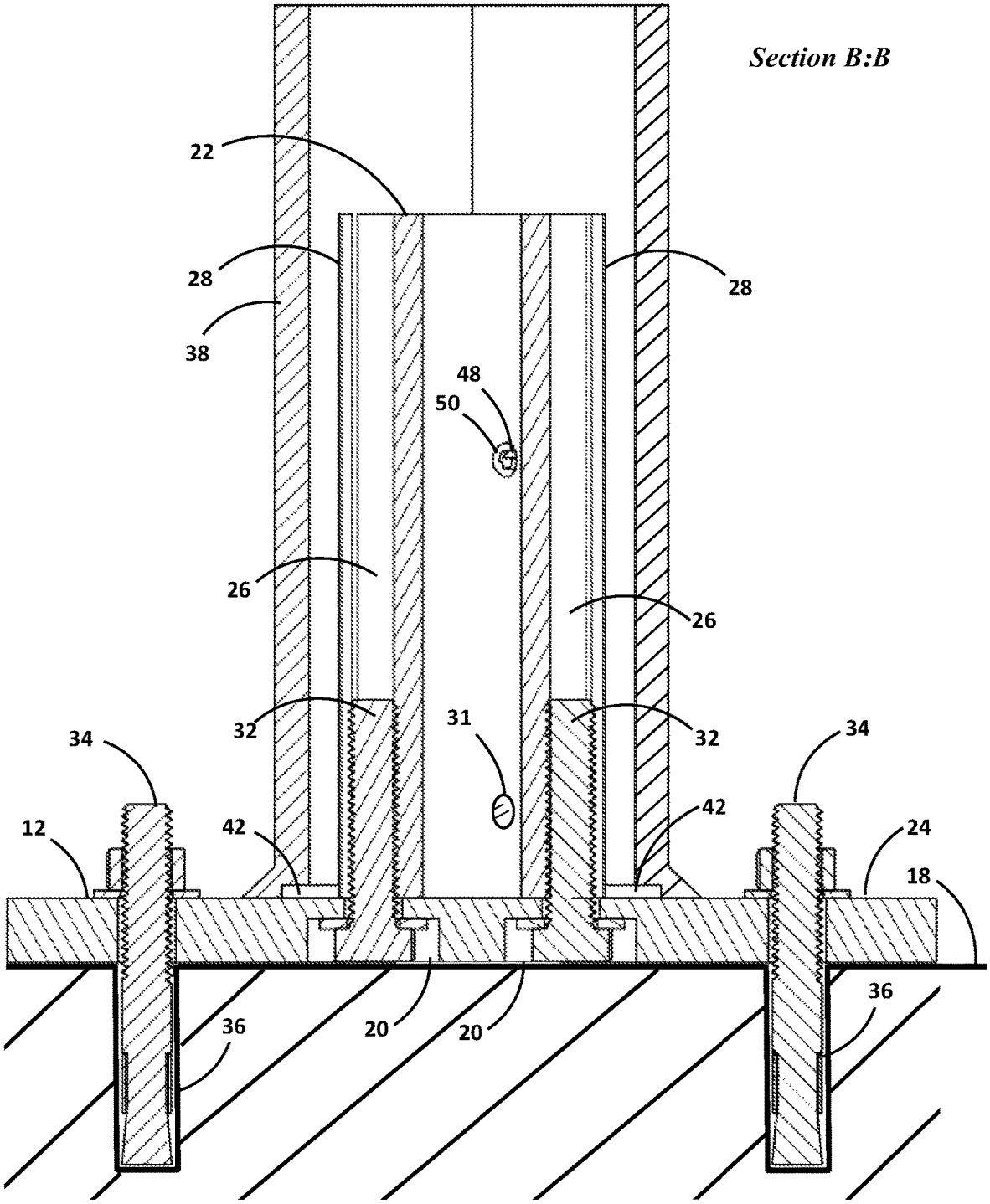
FIG. 7 is a cross section view along the line B-B from FIG. 3.

Referring now to FIGS. 1-7, the reinforced mechanical post system 10 is shown in its preferred embodiment. FIG. 1 shows an exploded view of the reinforced mechanical post system 10 undergoing the first step of assembly. Here is shown a square baseplate 12 having an outer set of mounting through holes 14 for mounting the bottom face 16 of the baseplate 12 to a solid surface 18 (as seen in FIG. 6 and FIG. 7) and an inner set of attachment through holes 20 for attachment of a reinforcement member 22 to the top face 24 of the baseplate 12. As shown in FIG. 4, the attachment through holes 20 in the baseplate 12 may be countersunk or recessed at the bottom face 16 to enable flush contact between the bottom face 16 of the baseplate 12 and the mounting surface 18 (as seen in FIG. 6). The reinforcement member 22 has an elongated extruded body and four channels 26 that correspond to the inner set of attachment through holes 20 on the baseplate 12. The channels 26 in the preferred embodiment run the whole length of the reinforcement member 22 and each comprise an opening 28 that runs the entire length of the channel 26. The channel openings 28 prevent water buildup within the channels 26 and allow any condensation to escape the reinforcement member 22 and flow downwards towards the baseplate 12 (as can be seen in FIG. 7). Grooves 30 also run the entire length of the reinforcement member's 22 outer walls for draining of condensation that forms within the reinforced post system 10 (as best seen by comparing FIGS. 5 and 6).

The reinforcement member 22 is bolted to the mounting baseplate 12 via four stainless-steel cap screws 32 that are fed through the attachment through holes 18 at the bottom face 16 of the baseplate 12. The cap screws 32 engage with the channels 26 in the reinforcement member 22 and create a sufficient pre-load between the reinforcement member 22 and the baseplate 12. Preload is the tension created in the cap screws 32 when they are threaded into the reinforcement member 22 through the baseplate 12. This tensile force in the cap screws 32 creates a compressive force between the reinforcement member 22 through the baseplate 12 known as clamp force. Proper preload, and thus clamp force, must be developed when joining the baseplate 12 and the reinforcement member 22 to minimize the likelihood of a variety of problems such as fatigue failure, joint separation, and self-loosening from vibration. This configuration offers much higher strength against tension, bending, and shear forces than the traditional joining method of welding. This is very important for fences or railings which must meet the strength requirements set forth by the International Code Council.

FIG. 2 shows the reinforced mechanical post system 10 undergoing the second step of assembly after the reinforcement member 22 has been secured to the baseplate 12. As best understood by comparing FIGS. 2 and 6, anchors 34 are fed through the mounting through holes 14 to mount the baseplate 12 to pre-drilled holes 36 in the solid surface 18 (shown in FIG. 6). In the preferred embodiment, anchors 34 are used for mounting. These anchors 34 expand within the pre-drilled holes 36 in the solid surface 18 when tightened. Other mounting systems and methods may be used, but the mounting method used is primarily determined by the mounting surface material and required strength of the mount.

A hollow post 38 is snuggly fit over said reinforcement member 22. The hollow post 38 may have a flanged or tapered bottom edge 40 to increase the contact area with the baseplate 12 and further protect the reinforcement member 22. Within the bottom edge 40 there may be a recessed area 42 which creates a fluid connection between the drainage grooves 30 and channels 26 on each side of the reinforcement member (shown in FIG. 5, FIG. 6, and FIG. 7). Water that enters the hollow center of the reinforcement member 22 may flow to the recessed area 42 and drain out via the through hole 31. The bottom edge 40 may also contain a weep hole 44 for drainage of any condensation within the reinforced mechanical post system 10 that flows into the recessed area 42. The peaks of the grooves 30 on the reinforcement member 22 contact the inner walls of the hollow post 38 to provide a snug fit (Shown in FIG. 5). A cap 46, sign, or other device may also be added to the top of the hollow post 38 to prevent dirt, precipitation, and other contaminants from entering the reinforced mechanical post system 10 (shown in FIG. 8). Similarly, a top rail may be added to the top of the hollow post 38 and extend across a plurality of reinforced mechanical post systems 10. As shown in FIG. 3, screws 48 may be added through the sides of the hollow post 38 such that they engage with the reinforcement member 22 to prevent relative movement between the hollow post 38 and the reinforcement member 22. These screws 48 may be self-tapping screws or they may be threaded into pre-drilled holes 50 in the hollow post 38 and reinforcement member 22 that line up during assembly. To simplify load calculations, it is preferred that these screws 48 are placed in line with the weep hole 44 and through hole 31 (see FIG. 3 and FIGS. 5 through 7). These screws 48 are not crucial to the design, as the snug fit between the reinforcement member 22 and the hollow post 32 can create a sufficient bond between the two components.

Figure 8A:
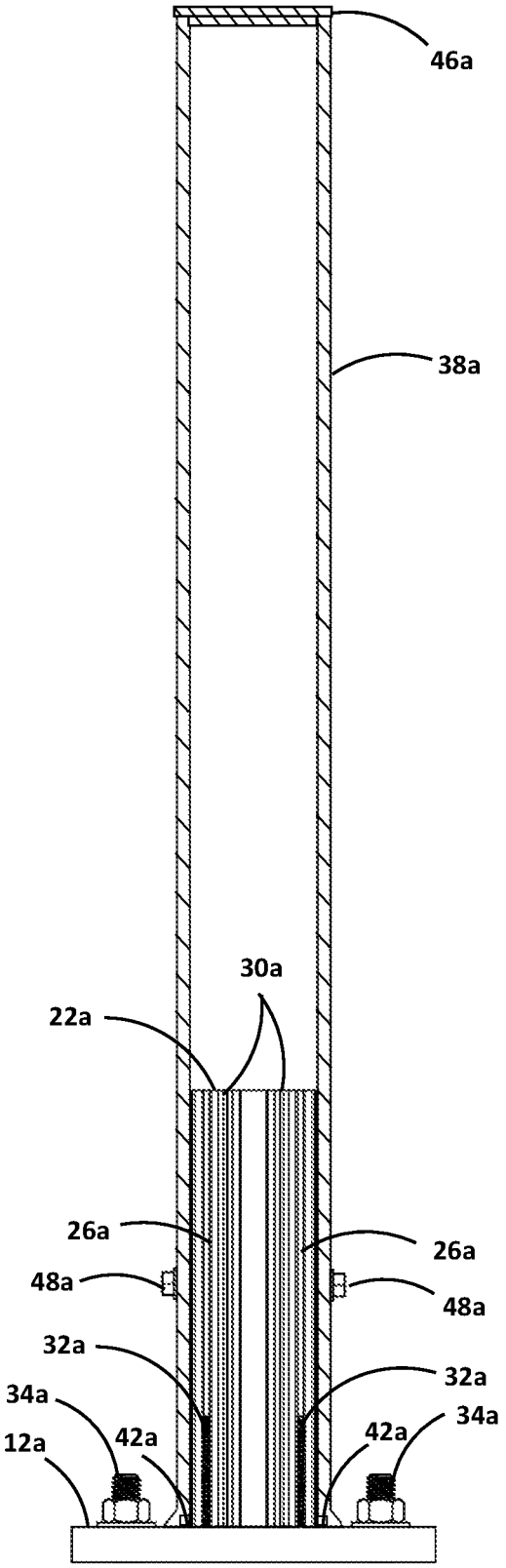
FIG. 8A shows an embodiment of reinforced mechanical post having a reinforcement member that is shorter than the hollow post.
Figure 8B:
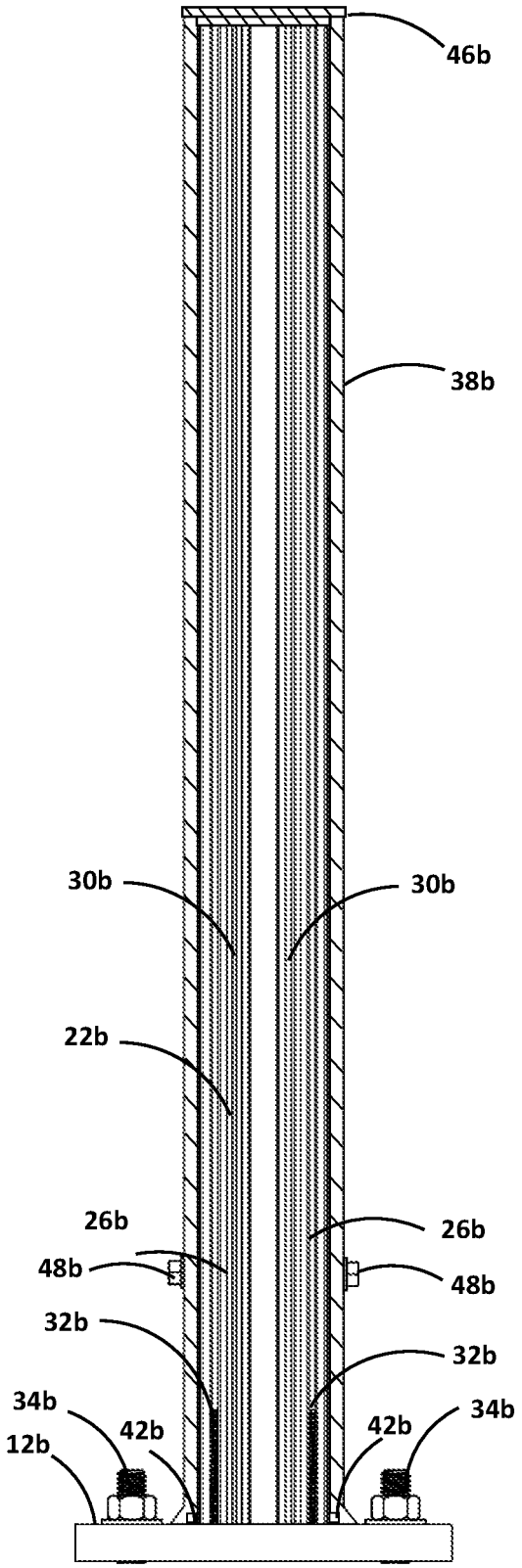
FIG. 8B shows an embodiment of reinforced mechanical post having a reinforcement member that extends the entire length of the hollow post.

The reinforced member 22 is preferably made from an extruded length of aluminum. This allows the reinforcement member 22 to be cut to the preferred length which may vary depending on the needs of the particular application. FIG. 8A shows an embodiment of reinforced post system 10*a* in which the reinforcement member 22*a* is about 6-inches long within the hollow post 38*a*. FIG. 8B shows an embodiment of reinforced post system 10*b* in which the reinforcement member 22*b* extends through the entire length of the hollow post 38*b*.

Figure 9:
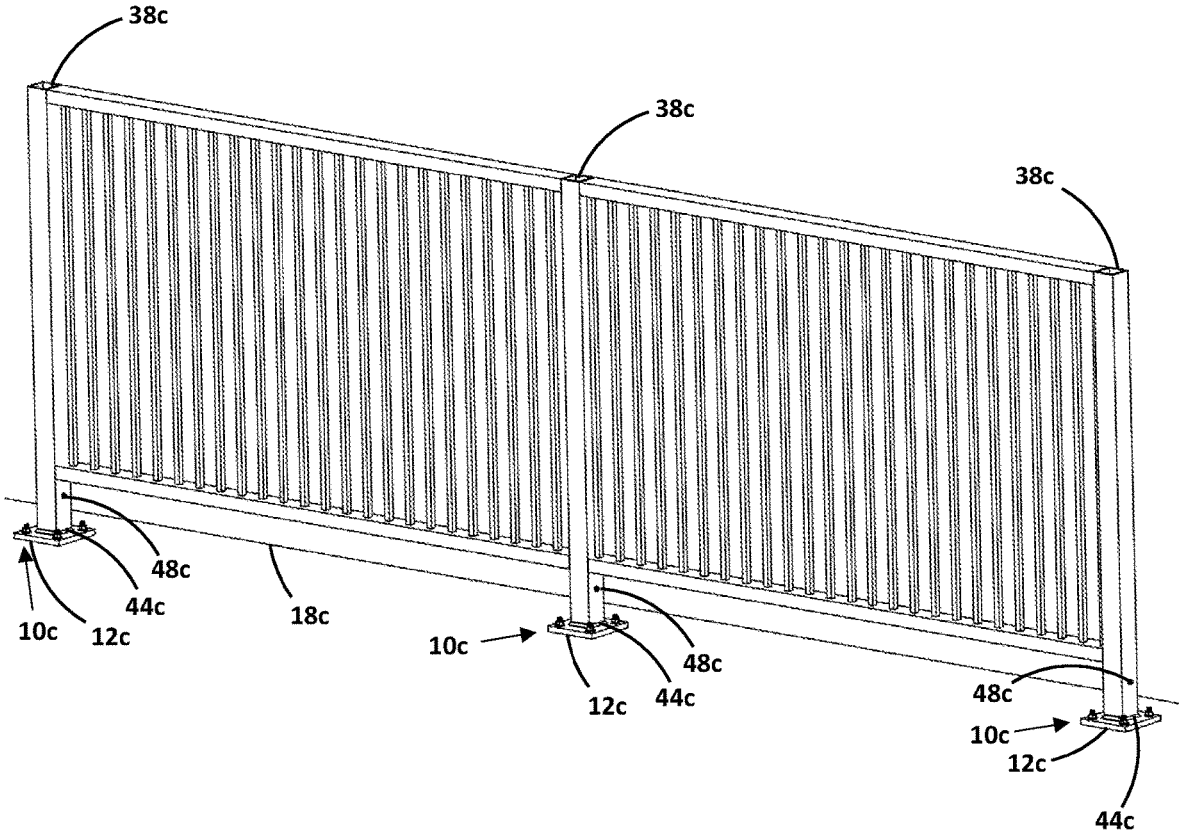
FIG. 9 is an isometric view of a plurality of reinforced mechanical posts vertically supporting a fence or railing.
Figure 10:
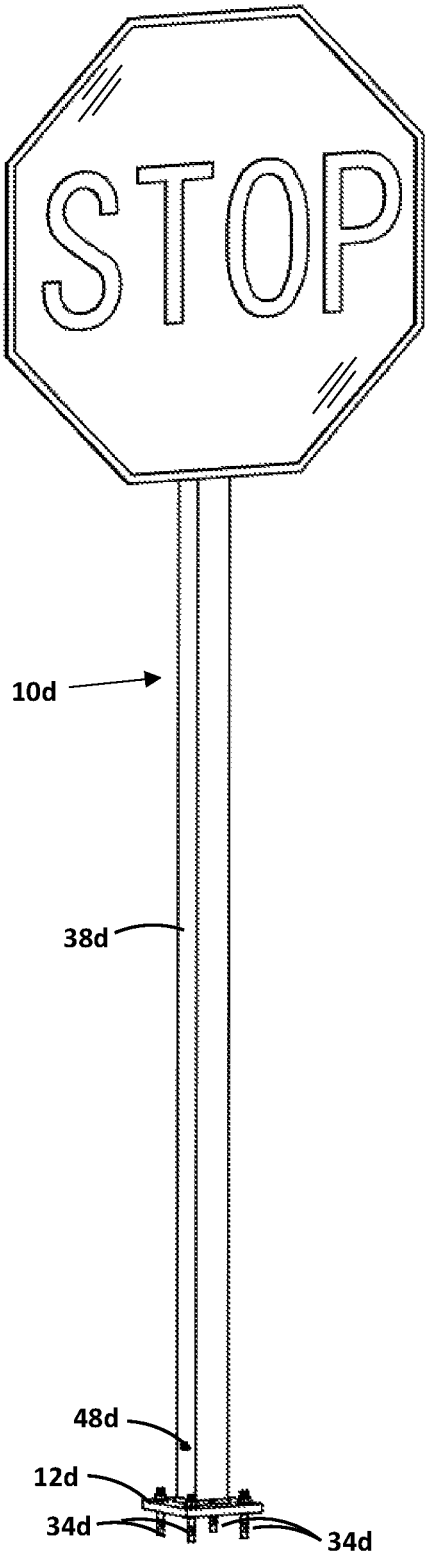
FIG. 10 is an isometric view of a reinforced mechanical post vertically supporting a sign.

FIG. 9 shows an embodiment of a plurality of reinforced mechanical post systems 10*c* incorporated into a length of fencing or railing. In this configuration, the force on a section of railing of fencing may be distributed over two or more reinforced mechanical post systems 10*c*. To simplify load calculations, it is preferred that the screws 48*c*, the weep hole 44*c*, and the through hole 31 in the reinforcement member 22 are placed in line with the railing as shown. FIG. 10 shows an instance of how the reinforced mechanical post system 10*d* may be used to support a vertically support a sign. Street signs such as the one shown face the constant cyclical loading from wind and other factors. The reinforced mechanical post system 10*d* minimizes deflection in the hollow post 38*d* from these forces and decreases the likelihood of fatigue failure. Many other uses can be conceived for this reinforced mechanical post systems 10. The reinforced mechanical post system 10 may also be scaled and a plurality may be used to support other structures such as sheds or houses (not shown).

Figure 11:
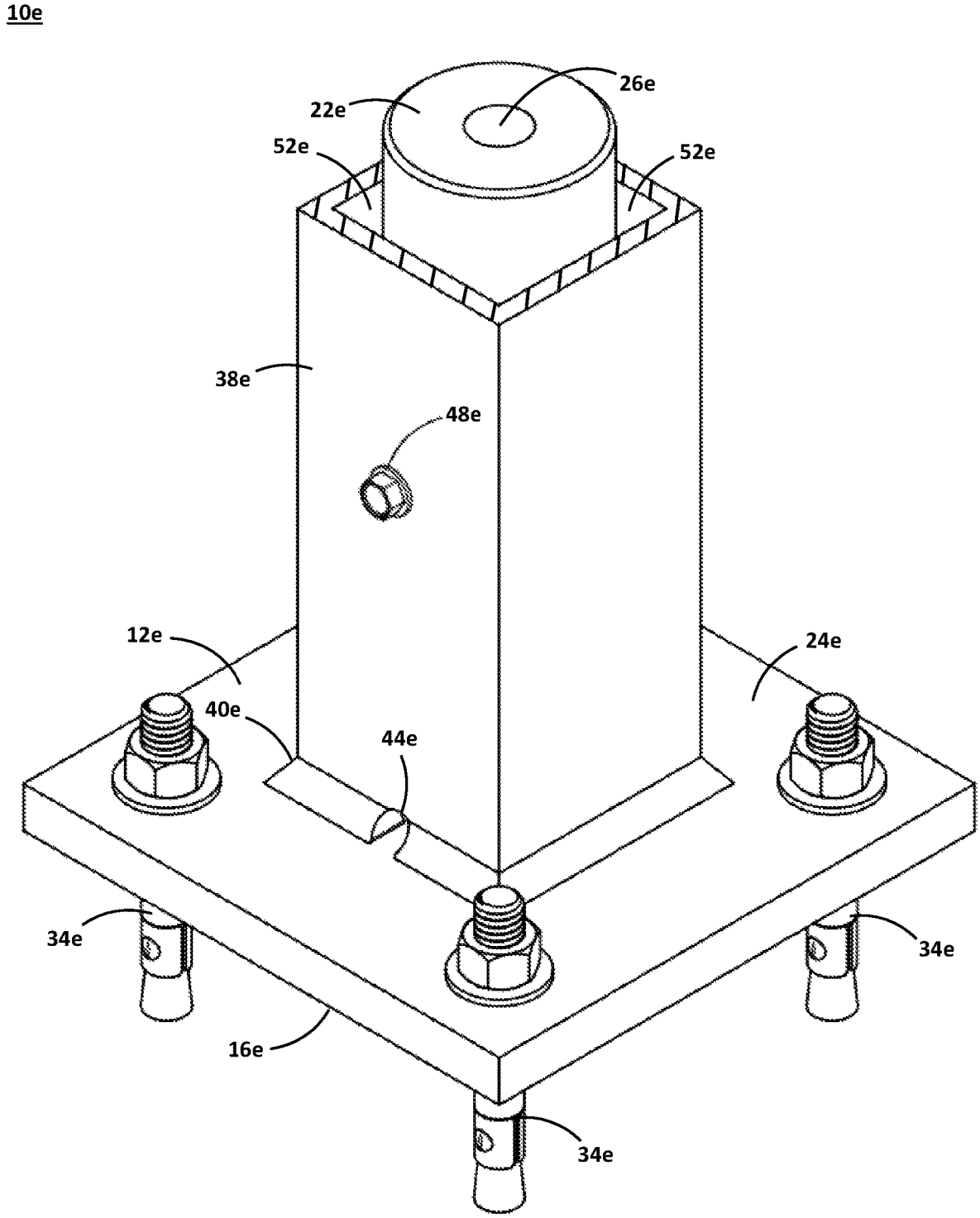
FIG. 11 is an isometric view of a reinforced mechanical post having a cylindrical reinforcement member.
Figure 12:
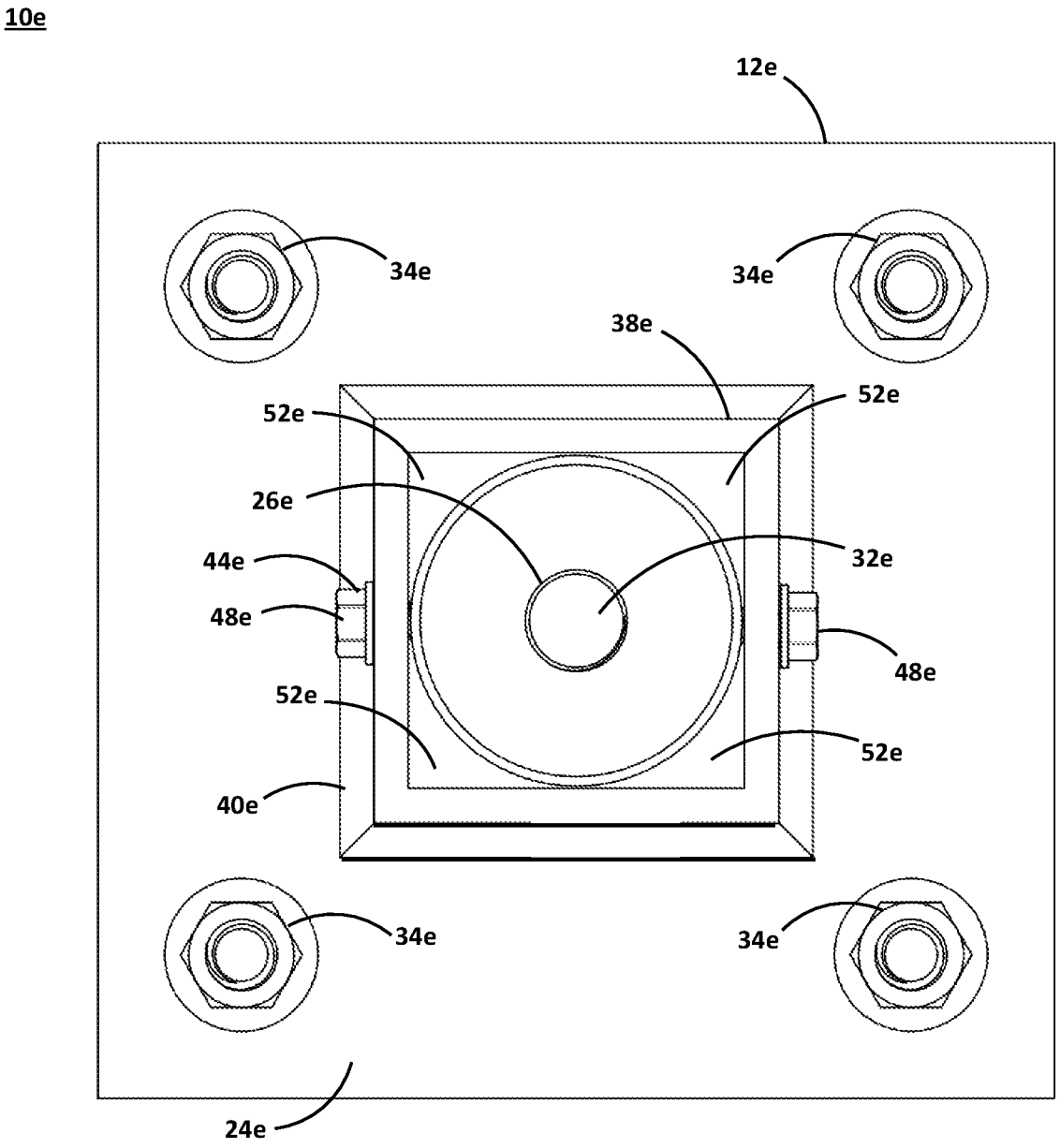
FIG. 12 is a top view of the reinforced mechanical post of FIG. 10.
Figure 13A:
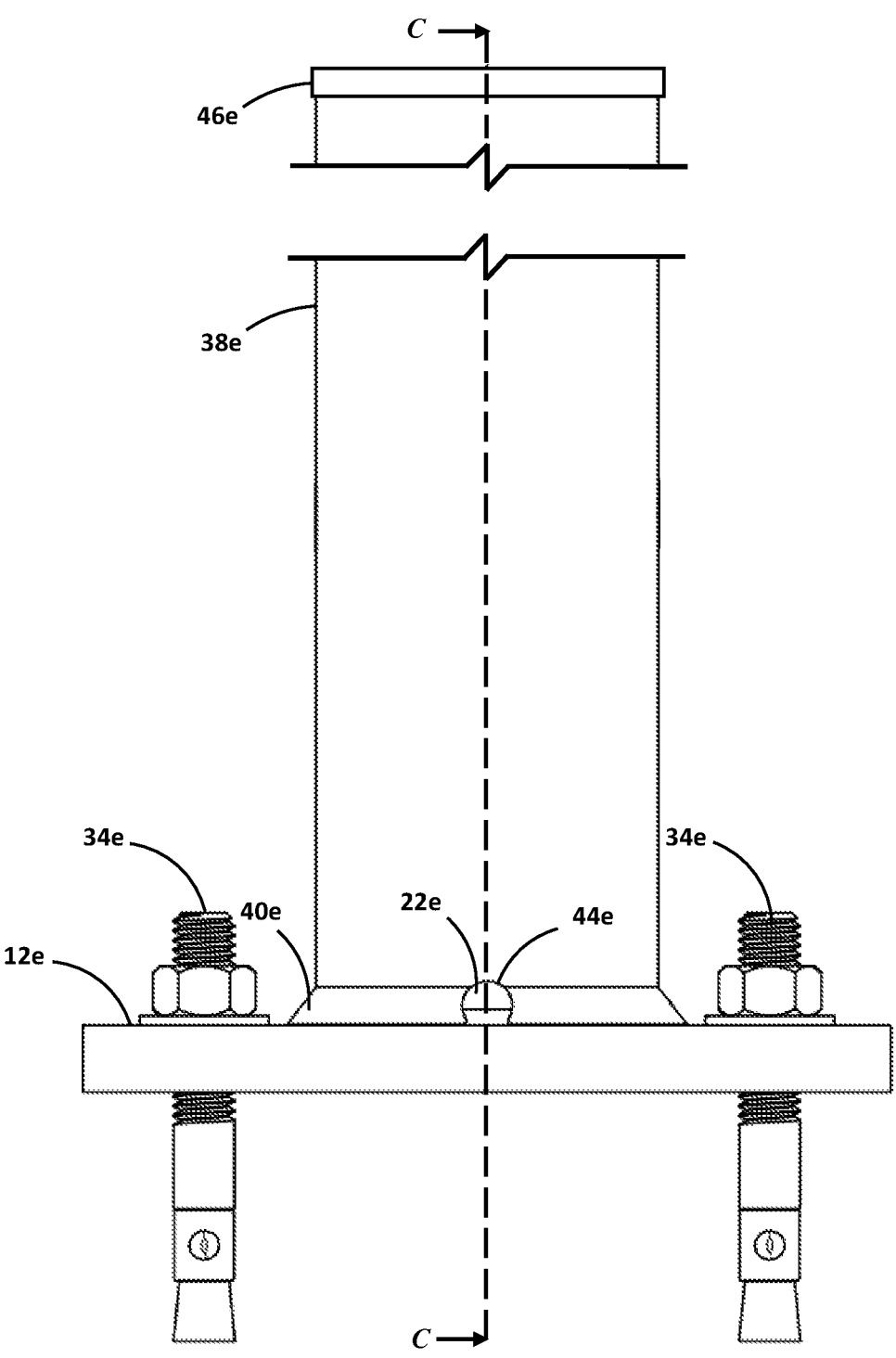
FIG. 13A is a front view of the reinforced mechanical post of FIG. 10.
Figure 13B:
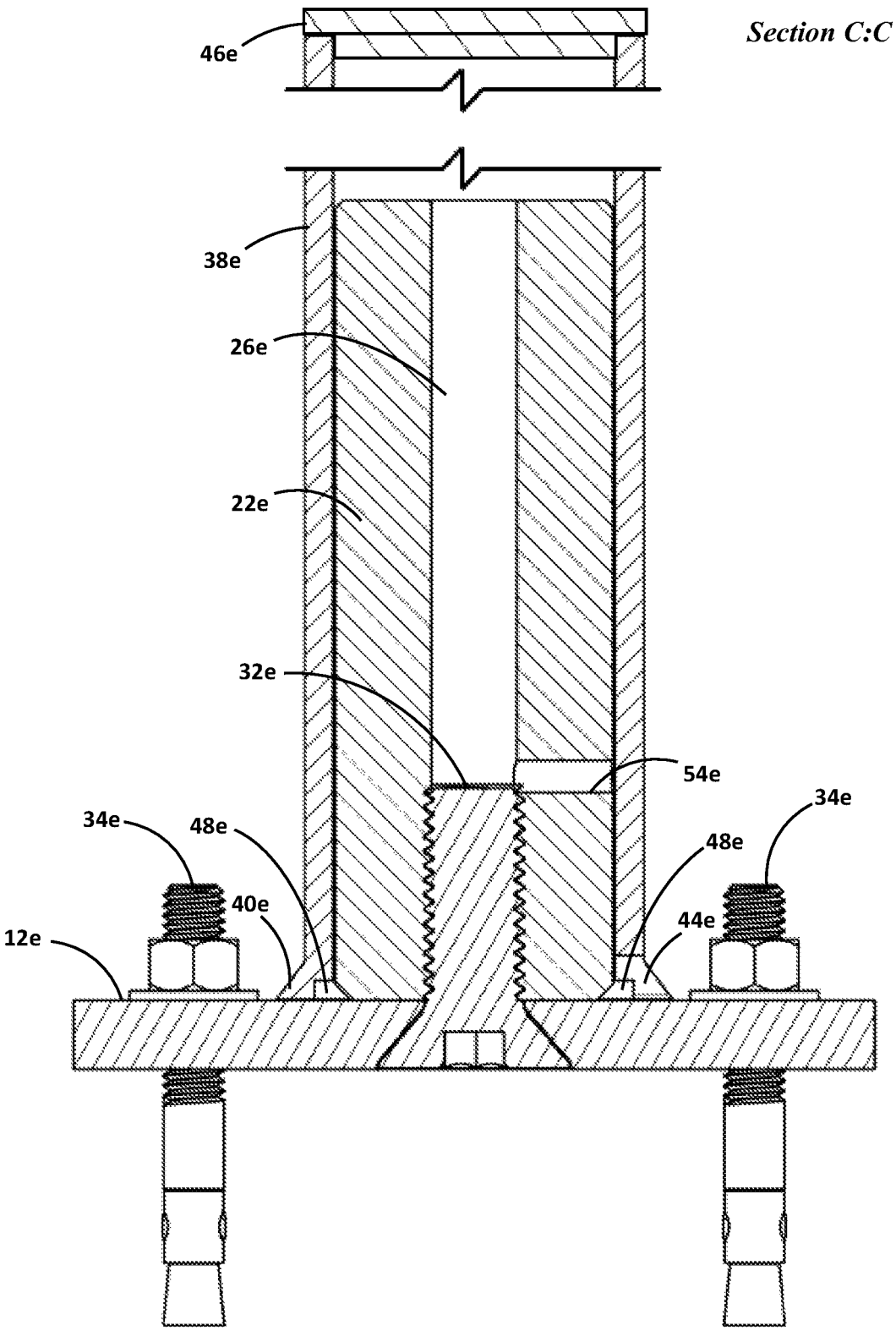
FIG. 13B is cross section view of the reinforced mechanical post of FIG. 12 cut along the line B-B.

FIG. 11 is a variation of the reinforced mechanical post system 10*e* in which the reinforcement member 22*e* has a circular cross section that forms an elongated cylindrical body. In this embodiment, the reinforcement member 22*e* is bolted to the mounting baseplate 12*e* via one cap screw 32*e* that is fed through the attachment through hole 20*e* at the bottom face 16*e* of the baseplate 12*e*. The cap screw 32*e* engages with the one central channel 26*e* in the reinforcement member 22*e* and creates a sufficient pre-load between the reinforcement member 22*e* and said baseplate 12*e*. As shown in FIG. 12, the reinforcement member 22*e* contacts each inner wall of the square hollow post 38*e*. This configuration leaves vacant areas 52*e* in the four inner corners of the hollow post 38*e*, which replace the need for grooves that run the entire length of the reinforcement member's 22*e* outer walls for draining of condensation that forms within the reinforced post system 10*e*. Condensation that forms within the reinforced post system 10*e* may flow down these vacant areas 52*e*, enter the recessed area 42*e*, and escape through the weep hole 44*e* at the bottom edge 40*e* of the hollow post 38*e*. If condensation enters the top of the channel 26*e*, a weep hole 54*e* may be added to the side of the reinforcement member 22*e* where the cap screw 32*e* ends as shown in FIG. 13A. and FIG. 13B. This weep hole 54*e* allows water to escape the channel 26*e* to the inside of the hollow post 38*e*, enter the recessed area 42*e*, and escape through the weep hole 44*e* at the bottom edge 40*e* of the hollow post 38*e*. Alternatively, the channel 26*e* may be plugged or sealed at its top surface to prevent condensation buildup within the channel 26*e*.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A reinforced post comprising:

a baseplate;

a reinforcement member having at least one channel on an outer surface of said reinforcement member, each said at least one channel for receiving a bolt;

said at least one channel having an inner surface, said bolt abutting said inner surface of said at least one channel;

said baseplate having a hole for each said at least one channel;

for each said hole said bolt engaged with said at least one channel through said hole to secure said reinforcement member to said baseplate; and a hollow post positioned over said reinforcement member.

2. The reinforced post of claim 1 further comprising each said hole is counter sunk or recessed into said baseplate for bolt clearance.

3. The reinforced post of claim 1 further comprising said baseplate is mounted to a surface.

4. The reinforced post of claim 1 further comprising said hollow post has a snug fit over said reinforcement member.

5. The reinforced post of claim 1 further comprising the outer geometry of said reinforcement member corresponds to the inner geometry of said hollow post.

6. The reinforced post of claim 1 further comprising the outer walls of said reinforcement member are at least partially in contact with the inner walls of said hollow post.

7. The reinforced post of claim 1 further comprising said hollow post is secured to said reinforcement member with screws, or bolts.

8. The reinforced post of claim 1 further comprising said hollow post has a weephole for drainage.

9. The reinforced post of claim 1 further comprising said reinforcement member is any length between 6 inches and the length of said hollow post.

10. The reinforced post of claim 1 further comprising said at least one channel has an opening for drainage.

11. The reinforced post of claim 1 further comprising said reinforcement member has grooves along its length for drainage.

12. The reinforced post of claim 1 further comprising said hollow post is connected to a railing, fence, or sign.

13. The reinforced post of claim 1 further comprising said reinforcement member having four said at least one channel.

14. The reinforced post of claim 1 further comprising said reinforcement member having four said at least one channel and said baseplate having four said holes corresponding to said channels.

* * * * *